United States Patent [19]

Anderson

[11] 4,362,781

[45] Dec. 7, 1982

[54] FLUSHABLE PREMOISTENED WIPER

[75] Inventor: Ralph L. Anderson, Boothwyn, Pa.

[73] Assignee: Scott Paper Company, Philadelphia, Pa.

[21] Appl. No.: 303,935

[22] Filed: Sep. 21, 1981

[51] Int. Cl.[3] ..... B32B 9/00; B08B 1/00

[52] U.S. Cl. ..... 428/291; 428/289; 428/498; 428/514; 428/913; 15/104.93; 15/209 R; 162/178; 162/168.1; 162/181.2

[58] Field of Search ..... 428/289, 514, 913, 498, 428/291; 15/104.93, 209 R; 162/181 A, 178, 168 R

[56] References Cited

U.S. PATENT DOCUMENTS

| | | | |
|---|---|---|---|
| 2,644,751 | 7/1953 | Frisch et al. | 162/178 |
| 2,644,752 | 7/1953 | Frisch et al. | 162/178 |
| 3,554,788 | 1/1971 | Fechillas | 428/289 |
| 3,846,158 | 11/1974 | Vasilyadis | 15/104.93 X |
| 3,881,210 | 5/1975 | Drach et al. | 15/104.93 |
| 3,923,592 | 12/1975 | George et al. | 162/168 |
| 4,117,187 | 9/1978 | Adams et al. | 15/104.93 |
| 4,242,408 | 12/1980 | Evani et al. | 428/514 |
| 4,309,469 | 1/1982 | Varona | 428/74 |

*Primary Examiner*—P. Ives

*Attorney, Agent, or Firm*—John A. Weygandt; John W. Kane, Jr.

[57] ABSTRACT

Pre-moistened wiper comprising a nonwoven web impregnated with a modified guar gum and wet with an aqueous lotion containing borate ions.

6 Claims, No Drawings

FLUSHABLE PREMOISTENED WIPER

BACKGROUND OF THE INVENTION

1. Field of the Invention

The present invention concerns a pre-moistened wiper comprising a nonwoven web having a majority of papermaking fibers, the web being impregnated with a modified guar gum, and a water based lotion containing borate ions for pre-moistening the web.

2. Description of the Prior Art

Flushable non-woven webs and fibrous batts have been made having temporary wet strength. One approach to obtain temporary wet strength employs a polyvinyl alcohol gelled with borate ions which gel breaks down in the presence of a large volume of water but retains strength temporarily in the presence of limited quantities of liquid. See for example U.S. Pat. No. 4,309,469 filed Apr. 13, 1979 and granted Jan. 5, 1982.

The prior art methods of obtaining temporary wet strength for a web are deficient with respect to maintaining wet strength over prolonged periods of time, (e.g., months) while wet with a water based lotion and subjected to extreme environmental conditions that can be encountered during shipment of commercial products and still be dispersible after use. Frequently, a product made by prior art methods lost its wet strength during prolonged contact with the water based lotion or lost its ability to disperse when immersed in large quantities of water after being exposed to elevated temperatures, e.g., 140° F.

The use of guar gum in flushable fibrous sheet material is known. See U. S. Pat. No. 3,554,788. However, U.S. Pat. No. 3,923,592, in Example 3, describes guar gum as providing insufficient dry strength for a flushable product which is to retain a high percentage of its dry strength when wetted.

SUMARY OF THE INVENTION

In accordance with the present invention, a nonwoven, adhesively bonded web containing a majority of papermaking fibers is impregnated with an aqueous solution of modified guar gum. The guar gum treated web is dried and then contacted with a water based lotion containing borate ions to complex the guar gum. The web has a tensile strength of at least 4 oz/in in at least one direction while wet with the water based lotion for prolonged periods and substantially losing the wet tensile strength when immersed in a volume of water at least ten times the weight of the web. The wet tensile strength is imparted to the web by the complexed guar gum. Said water based lotion containing an active amount of borate may also include desired lotion ingredients such as a fragrance, soap, or a preservative and is adjusted to a pH in a range of about 8 to 10. In addition, the nonwoven web may be adhesively bonded with a minor proportion of water insoluble latex to increase its wet strength when a guar gum of the type capable of complexing with borate is included in major proportion in the web.

As used herein, the term "guar gum" encompasses any of the polyhydroxy derivatives of the poly galactomannans, including locust bean gum. The modified guar gum for use in the present invention either contains phosphates to lower its viscosity relative to the concentration of solution solids or is a hydroxypropyl substituted guar gum. For purposes of the present invention, both such gums are comprehended under the term "modified guar gum."

DETAILED DESCRIPTION OF THE INVENTION

The web component of the impregnated wiper contains a majority of short fibers and may be a dry formed web or a non-wet strengthened, wet lay paper web.

Dry-formed webs are a class of non-woven materials produced by processes other than the classical wet-lay papermaking process of slurrying fibers in water and then forming the web by depositing the fibers on a foraminous surface through which the water passes. Dry-forming processes do not employ a water and fiber slurry and accordingly they are referred to as "dry" formed although moisture may be present during the forming process. Typical dry-formed, nonwoven webs suitable for the present invention are air laid webs and carded webs provided they are produced from a majority of papermaking length fibers (minor quantities of textile length fibers can be admixed therewith). The fibers are usually wood pulp fibers although cotton linters and synthetic fibers such as rayon, polyester and mixtures thereof are suitable, provided a majority of the web fibers are of papermaking length or shorter (average length of $\frac{3}{8}$ inches or less for the papermaking fibers). The fibers are dispersed in a gaseous fluid, typically air, and deposited upon a foraminous surface to form the web. Apparatus for forming such webs are usually referred to as dry web formers and are available commercially.

The dry formed web must be adhesively bonded to give the web structural integrity. The adhesively treated web is dried to cure the adhesive. Sometimes moisture is added in minor quantities at various points in the production process but the webs are still referred to in the art as "dry-formed". Without the adhesive, the web would have little or no strength and could not be manipulated in subsequent conversion steps.

Wet lay paper webs are suitable for use in the present invention provided they do not contain conventional wet strength resins in sufficient quantity to give the web a wet tensile strength in any direction of greater than about 4 ounces per inch. Such a wet laid paper web is referred to herein as a non-wet-strengthened paper web. Such non-wet-strengthened paper webs when strengthened with the adhesive composition of the present invention and wet with the lotion will have a tensile strength of greater than 4 oz./in. in at least one direction but still be dispersible in water.

The main inventive concept of the present invention concerns the use of modified guar gum in combination with a water based lotion having an alkaline pH and containing borate ions.

The fibers of the web are bound together with a modified guar gum to give the web strength and structural integrity. From about 5% to about 14% guar gum is added to the web based upon the weight of polymer solids and the weight of air dry fibers in the web. Preferably about 10% guar gum is added to the web. Conventional methods of applying adhesives to dry-formed webs are suitable for use in the present invention including such methods as spraying the composition onto the formed web, foaming the composition and spreading the foam over the web, and printing the composition onto the web in a continuous or discontinuous printed pattern of discrete areas of wet-strength composition by well known methods such as gravure roll printing.

The preferred method of application is foaming because it permits the application of the desired level of solids in a single operation if foam is coated on both sides of the web. A hydroxypropyl substituted guar gum is especially suitable for this method as it entrains air well. Preferably, the modified guar gum is applied uniformly across both surfaces of the web and penetrates into the web to effectively bond the fibers into a web. Because the majority of the fibers are of a papermaking length (average length of 10 mm or less), the wet strength of the web is essentially due to the complexed guar gum.

If desired, a minor proportion of conventional wet-strength latex may be applied to the fibrous web. Preferably the amount is 20% by weight of solids relative to the total weight of the adhesive, the balance of 80% being modified guar gum.

The wet-strength latex may be a non-self-cross-linking, water dispersable, thermosetting polymer emulsion capable of functioning as a fiber adhesive, having a molecular weight of at least about 100,000 and being a film forming polymer having a glass transition temperature in the range of from about −50° C. to about +45° C. (temperature at which the torsional modulus of an air dried film of polymer solids is 300 kg./cm. 2). "Non-self-cross-linking" means a polymer without a suitable cross-linking moiety in the polymer chain for cross-linking with an adjacent polymer chain either directly or through with a cross-linking agent. Such polymers are usually referred to in the industry as non-cross-linking or cross-linkable but not as self-cross-linking. Such polymers are usually polyacrylic or polyvinyl polymers or copolymers thereof. Water dispersible means the polymer is water insoluble but dispersible to form an emulsion in water sometimes with the air of an emulsifier (a surfactant). In addition to acrylic polymers, suitable polymers include vinyl, nitrile and styrene butadiene polymers and copolymers thereof such as ethylene vinyl acetate.

Alternatively, the wet-strength latex may be a water dispersible, self-cross-linking polymer having incorporated in the polymer reactive sites which make the polymer self-cross-linking. Typical reactive sites include the carboxyl or N-methylol acrylamide functional group. Suitable polymers are those having a molecular weight greater than about 100,000 and a first order glass transition temperature (temperature at which the torsional modulus of an air-dried film of the polymer solids is 300 kg./cm.$^2$) in the range of −50° C. to +45° C. Typical self-cross-linking polymer emulsions suitable for the present invention include acrylic, nitrile, vinyl and styrene butadiene polymers and copolymers thereof.

After impregnation with the modified guar gum and drying, the web is wet (usually saturated) with the lotion. The lotion is a water solution containing borate ions (usually obtained from boric acid although other equivalent sources of borate ions could be used such as sodium borate). The lotion should contain an active amount of borate ions sufficient to form a complex with the guar gum and impart wet strength to the web. Said active amount is normally present in a solution of at least 0.5% boric acid at a pH of in the range of about 8.0 to 10.0. A lotion containing 0.5% to 3% boric acid is preferred.

The pH of the water lotion preferably is adjusted to the alkaline side. A pH in the range of from 8 to 9 is particularly suitable especially when buffered with a suitable buffer such as triethanolamine. Preferably the web is packaged wet with from about 100% to about 600% lotion based upon the air dry weight of the web to obtain a suitable pre-moistened wiper having significant wet strength.

The guar gum interacts with the borate ions in the lotion to produce a water-resistant gel thereby strengthening the web while wet with the borate containing lotion. The interaction is markedly improved with ions of an organic hydroxy acid or a keto acid capable of complexing with borate ions. A compound capable of complexing with the borate ion in the water based lotion significantly increases the effectiveness of the lotion. An organic hydroxy acid or keto acid or salts thereof such as sodium, potassium, lithium, ammonium and magnesium salts are suitable. Alpha-hydroxy aliphatic acids, o-aromatic hydroxy acids, alicyclic hydroxy acids and keto acids are generally suitable for forming a complex with borate ions. The ability of an organic acid or its salt to form a complex with borate ions is indicated by an incremental increase in the conductivity of a boric acid solution in the presence of the organic acid or its salt. An "incremental increase in conductivity" is an increase in the observed conductivity of the organic acid (or salt) and boric acid solution minus the sum of the conductivities of the individual organic acid (or salt) and boric acid solutions.

Particularly suitable are salts of alpha or o-hydroxy carboxylic acids, especially alpha-hydroxy dibasic acids. Sodium or potassium tartrate, potassium citrate, and lactate and salicylate salts of sodium or potassium are quite suitable with potassium citrate being the most preferred. A listing of suitable alpha-hydroxy acids, o-aromatic hydroxy acids, keto acids and alicyclic alpha-hydroxy acids capable of increasing the conductivity of a boric acid solution is contained in *Organoboron Chemistry*, Volume 1, Howard Steinberg, Interscience Publishers, 1964 in Table 16-2 beginning at page 748. The sodium, potassium, lithium, ammonium and magnesium salts of such acids are particulary suitable for use in the lotion of the present invention in conjunction with borate ions. Table 16-2 of the *Organoboron Chemistry* text shows alpha-hydroxy acids having 2 to 8 carbon atoms; o-aromatic hydroxy acids having 7 to 11 carbon atoms; alicyclic alpha-hydroxy acids having 4 to 8 carbon atoms; and keto acids having 3 to 10 carbon atoms as being suitable. The molar ratio of borate species in solution to the compound capable of complexing with borate should be from 0.1:1 to 1.6:1 with 0.5:1 preferred. For the purpose of this ratio, the dissociated compound (ions) in the lotion solution are considered equivalent to undissociated compound.

A web treated with modified guar gum retains the ability to disperse while packaged for prolonged periods in a lotion containing borate ions and a compound capable of forming a complex with borate ions derived as defined above. Compared to a web provided with wet strength by polyvinyl alcohol gelled with borate ions, the web of the present invention exhibits better stability when subjected to aging at elevated temperature, both in respect of retention of wet tensile and dispersibility. Furthermore the guar gum can be complexed with a lower concentration of boric acid than polyvinyl alcohol can. This is important because of the toxicity of boric acid and its ability to be readily absorbed through the human skin. Also, because of the limited solubility of boric acid in water, if the concentration is high crystallization of boric acid can occur when the wipe is exposed to air, which markedly distracts from the appearance of the product.

The following examples show the functionality of the present invention in that an adhesive formulation has been achieved which imparts substantial wet strength to a web during prolonged contact with a water based lotion even in extreme environments, but which web is dispersible as tested because the wet strength of the web substantially decreases when the web is exposed to a large volume of water. All percentages and parts given herein are based on weight unless indicated otherwise.

EXAMPLE I

An air laid web having a basis weight of 60 g/m$^2$ was impregnated with an aqueous binder mixture comprising a type of phosphated guar gum which at a solids concentration of 1.5% has a viscosity of 1000 centipoise (cps). Application was effected by foam coating on both sides of the web so that the amount of guar gum applied was equal to 12% by weight of the web.

The web was dried and then impregnated with the following lotion in an amount equal to 250% by weight of the dry web.

| Lotion Ingredient | Parts by weight |
|---|---|
| boric acid | 1% |
| potassium citrate | 1% |
| triethanol amine | as needed (to buffer solution to pH 8.5) |
| bacteriacide | 0.15% |
| water | 97.85% |

One hour after wetting with the lotion the web had a machine direction tensile strength of 20 ounces per inch and after one week at 145° F. 18.6 oz/in. When gently agitated in water one hour after wetting, a sample of the web dispersed in 259 seconds; one week after wetting, in 120 seconds.

EXAMPLE II

An air laid web having a basis weight of 60 g/m$^2$ was impregnated with an aqueous binder mixture comprising a hydroxypropyl guar gum. Application was effected by foam coating on both sides of the web so that the amount of guar gum applied was equal to 5% by weight of the web.

The web was dried and then impregnated with the following lotion in an amount equal to 250% by weight of the dry web.

| Lotion Ingredient | Parts by weight |
|---|---|
| boric acid | 3% |
| isopropyl alcohol | 48.5% |
| water | 48.5% |

One our after wetting with the lotion the web had a machine direction tensile strength of 16 oz per inch and after three days at 145° F. 6 oz/in. When gently agitated in water one hour after wetting, a sample of the web dispersed in 170 seconds; three days after wetting, in 85 seconds.

COMPARATIVE EXAMPLE

In order to illustrate the surprising and unexpected results of the present invention a web was prepared utilizing a different guar gum, not "modified" as defined herein.

An air laid web having a basis weight of 60 g/m$^2$ was impregnated with an aqueous binder mixture comprising quaternized guar gum. Application was effected by foam coating on both sides of the web so that the amount of guar gum applied was equal to 5% by weight of the web.

The web was dried and then impregnated with the lotion of Example II in an amount equal to 250% by weight of the dry web.

On hour after wetting with the lotion the web had a machine direction tensile strength of 5 ounces per inch and after three days at 145° F. 4 oz/in. When gently agitated in water one our after wetting, a sample of the web required over 1000 seconds to disperse; three days after wetting over 1000 seconds were still required, an unacceptably long time by commercial standards.

EXAMPLE III

An air laid web having a basis weight of 60 g/m$^2$ was impregnated with an aqueous binder mixture comprising a 16% of high styrene SBR latex and 84% of the phosphated guar gum of Example I. Application was effected by foam coating on both sides of the web so that the amount of guar gum applied was equal to 14% by weight of the web.

The web was dried and then impregnated with the following lotion in an amount equal to 250% by weight of the dry web.

| Lotion Ingredient | Parts by weight |
|---|---|
| sodium borate | 1% |
| isopropyl alcohol | 48.85% |
| bacteriacide | 0.15% |
| water | 50.0% |

One hour after wetting with the lotion the web had a machine direction tensile strength of 33 ounces per inch and after three days at 145° F. 23 oz/in. When gently agitated in water one hour after wetting, a sample of the web dispersed in 450 seconds; three days after wetting, in 320 seconds.

EXAMPLE IV

An air laid web having a basis weight of 60 g/m$^2$ was impregnated with a aqueous binder mixture comprising a 20% acrylic latex and 80% of the phosphated guar gum of Example I. Application was affected by foam coating on both sides of the web so that the amount of guar gum applied was equal to 12% by weight of the web.

The web was dried and then impregnated with the lotion of Example III in an amount equal to 250% by weight of the dry web.

One hour after wetting with the lotion the web had a machine direction tensile strength of 19 ounces per inch and after three days at 145° F. 13 oz/in. When gently agitated in water one hour after wetting, a sample of the web dispersed in 320 seconds; three days after wetting, in 500 seconds.

Although the invention has been described with reference to preferred embodiments thereof, it is to be understood that various changes may be resorted to by one skilled in the art without departing from the spirit and scope of the invention as defined by the appended claims.

What is claimed is:

1. A water-dispersible pre-moistened wiper comprising a non-woven web having a majority of papermaking fibers, said web being impregnated with a modified guar gum, and an aqueous, alkaline lotion containing borate ions.

2. The wiper according to claim 1 wherein the modified guar gum is a phosphated guar gum.

3. The wiper according to claim 1 wherein the modified guar gum is a hydroxypropyl substituted guar gum.

4. The wiper according to claim 1 wherein the modified guar gum is present in an amount measured as polymer solids, of from 5% to 14% by weight of air dry fibers in the web.

5. The wiper according to claim 1 wherein the lotion further contains an organic hydroxy acid or a keto acid or a salt thereof capable of complexing with borate ions.

6. The wiper according to claim 5 wherein the salt of the organic hydroxy acid is potassium citrate.

* * * * *